United States Patent [19]

Mizrahi et al.

[11] Patent Number: 4,968,406

[45] Date of Patent: Nov. 6, 1990

[54] INCREASING FEED VOLUME THROUGHPUT IN FCC PROCESS

[75] Inventors: Sadi Mizrahi, Cherry Hill, N.J.; James C. Vartuli, West Chester, Pa.

[73] Assignee: Mobil Oil Corporation, New York, N.Y.

[21] Appl. No.: 252,873

[22] Filed: Oct. 29, 1988

[51] Int. Cl.[5] ..... C10G 11/05

[52] U.S. Cl. ..... 208/120; 208/121; 502/65; 502/67

[58] Field of Search ..... 208/120, 118, 122, 121, 208/119, 124; 502/65, 67

[56] References Cited

U.S. PATENT DOCUMENTS 4,430,200 2/1984 Shihabi ..... 208/120

4,477,582 10/1984 Miale ..... 208/120

4,481,104 11/1984 Walsh ..... 502/64

4,624,774 11/1986 Chang et al. ..... 208/119

4,724,067 2/1988 Raatz et al. ..... 208/120

4,740,292 4/1988 Chen et al. ..... 208/120

*Primary Examiner*—Anthony McFarlane

*Attorney, Agent, or Firm*—Alexander J. McKillop; Charles J. Speciale; Marina V. Schneller

[57] ABSTRACT

A process for increasing the volume of feed throughput to the catalytic cracker by decreasing hydrogen and total gas volume production, under catalytic cracking conditions temperature of 950° F. to about 1150° F., a catalyst to feed ratio of 3:1 to 10:1 and a catalyst contact time of from about 1 to about 20 in the presence of catalyst comprising ZSM-20 and a matrix.

12 Claims, 1 Drawing Sheet

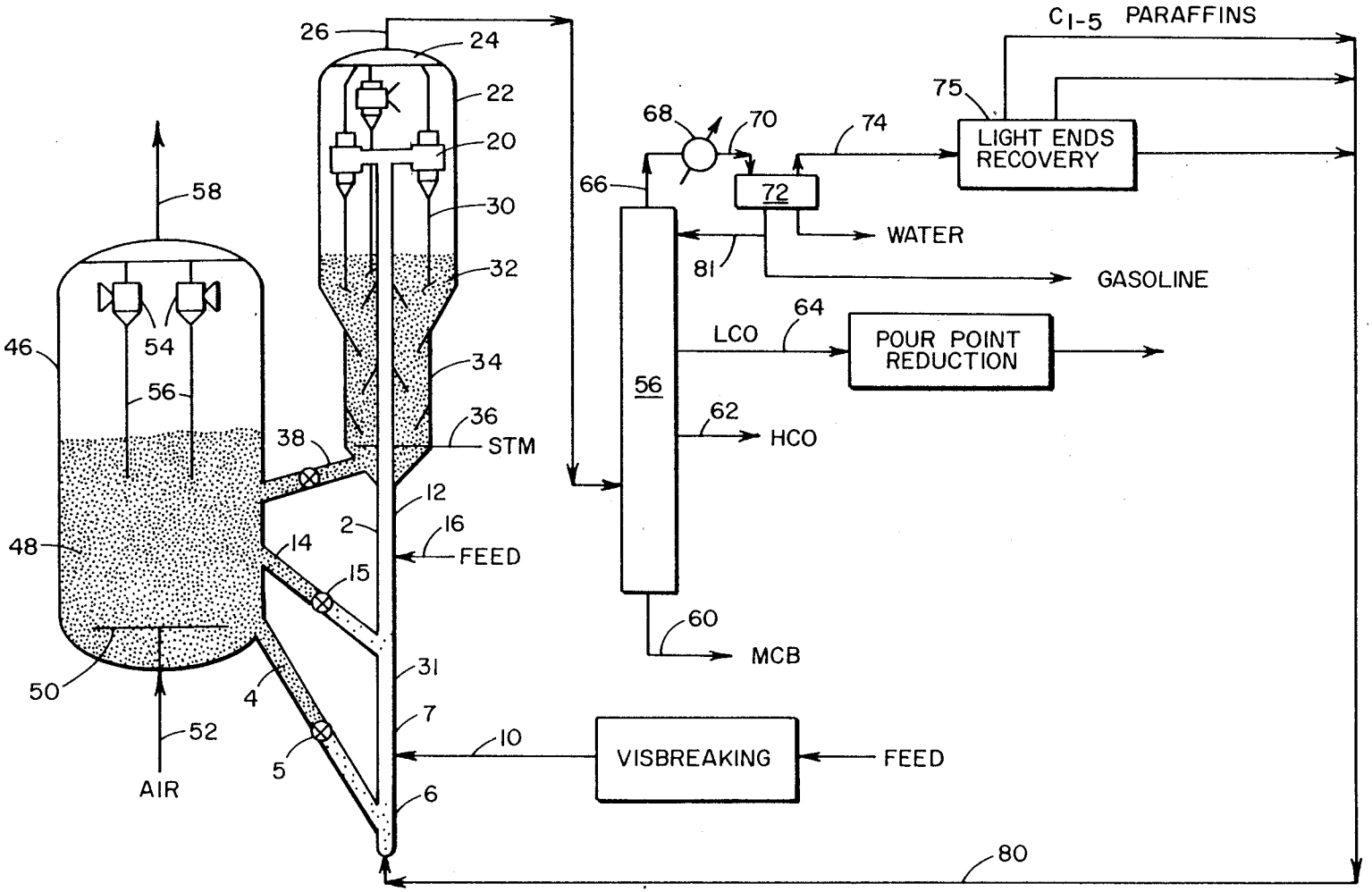
C1-5 PARAFFINS
LIGHT ENDS RECOVERY
75
74
WATER
GASOLINE
POUR POINT REDUCTION
64
LCO
HCO
62
MCB
60
FEED
VISBREAKING
80
70
68
72
81
66
56
24
22
20
30
32
34
36
STM
12
16
FEED
31
7
6
10
26
2
15
38
14
5
4
58
54
56
52
AIR
46
48
50

INCREASING FEED VOLUME THROUGHPUT IN FCC PROCESS

FIELD OF THE INVENTION

The process of the invention resides in upgrading heavy hydrocarbon feeds under catalytic cracking conditions, including employing ZSM-20 as a catalyst component, to control the total gas make, and specifically to decrease hydrogen production, to maximize feed volume throughput to the unit by decreasing the load on the gas product compressor.

BACKGROUND OF THE INVENTION

The present invention provides a process for catalytically cracking a hydrocarbon feed to a product comprising gasoline in the presence of a cracking catalyst under catalytic cracking conditions. Catalytic cracking units which are amenable to the process of the invention operate at temperatures from 400° F. (205° C.) to 1600° F. (871° C.), and under reduced, atmospheric or superatmospheric pressure. The catalytic process can be either fixed bed, moving bed or fluidized bed and the hydrocarbon flow may be either concurrent or countercurrent to the catalyst flow. The process of the invention is particularly applicable to fluid catalytic cracking.

In fluidized catalytic cracking processes, a relatively heavy hydrocarbon feedstock, e.g., a gas oil, admixed with a suitable cracking catalyst to provide a fluidized suspension, is cracked in an elongated reactor, or riser, at elevated temperature to provide a mixture of lighter hydrocarbon products. The gasiform reaction products and spent catalyst are discharged from the riser into a separator, e.g., a cyclone unit, located within the upper section of an enclosed stripping vessel, or stripper, with the reaction products being conveyed to a product recovery zone and the spent catalyst entering a dense catalyst bed within the lower section of the stripper. In order to remove entrained hydrocarbon product from the spent catalyst prior to conveying the latter to a catalyst regenerator unit, an inert stripping gas, e.g., steam, is passed through the catalyst where it desorbs such hydrocarbons conveying them to the product recovery zone. The fluidizable catalyst is continuously circulated between the riser and the regenerator and serves to transfer heat from the latter to the former thereby supplying the thermal needs of the cracking reaction which is endothermic.

Gas from the FCC main-column overhead receiver is compressed and directed with primary-absorber bottoms and stripper overhead gas through a cooler to the high-pressure receiver. Gas from this receiver is routed to the primary absorber, where it is contacted by the unstabilized gasoline from the main-column overhead receiver. The net effect of this contacting is a separation between $C_3+$ and $C_2-$ fractions on the feed to the primary absorber. Primary-absorber off gas is directed to a secondary or sponge absorber, where a circulating stream of light-cycle oil from the main column is used to absorb most of the remaining $C_5+$ material in the sponge absorber feed. Some $C_3$ and $C_4$ material is also absorbed. The sponge-absorber rich oil is returned to the FCC main column. The sponge-absorber overhead, with most of the valuable $C_5+$ material removed but including $H_2S$, is sent to fuel-gas or other processing.

Liquid from the high-pressure separator is sent to a stripper, where most of the $C_2-$ is removed overhead and sent back to the high pressure separator. The bottoms liquid from the stripper is sent to the debutanizer, where an olefinic $C_3$–$C_4$ product is separated and can be sent to either alkylation or catalytic condensation for further gasoline production. The debutanizer bottoms, the stabilized gasoline, is sent to treating, if necessary, and then to storage.

Limits on conversion or throughput to the FCC are imposed by the gas volume capacity of the gas compressor receiving gas from the FCC main-column overhead receiver. Hydrogen as well as other hydrocarbon products gaseous at ambient conditions $C_1$ (methane) and $C_2$ (ethane, ethylene) are produced during the upgrading. The ratio of the moles of hydrogen produced to the sum of the moles of $C_1$ plus $C_2$ produced times 100 is referred to as the hydrogen factor. In general, this ratio could be effected by the metals content of a heavy hydrocarbon feed; higher metals containing feeds lead to higher hydrogen production and higher hydrogen factors.

SUMMARY OF THE INVENTION

In accordance with the invention, hydrocarbons with boiling points of 400° F.+ are processed under conditions of catalytic cracking, using ZSM-20 containing catalysts. The catalyst effectively reduces hydrogen gas production relative to $C_1$ and $C_2$ gaseous products, compared to conventionally avilable processes without increasing wet gas production (lower hydrogen factor).

Accordingly, the volume capacity of the wet gas compressor receiving overhead from the catalytic cracker is effectively increased with respect to the volume throughput or conversion. The lower hydrogen factor also increases feed flexibility in allowing the processing of heavy metals (i.e., Ni, Vn) containing feeds. It also provides additional process flexibility by reducing catalyst makeup rates and pass metals passivator addition. The correlative feed volume throughput increase, together with the higher octane and higher gasoline yield of the catalyst can provide the refiner with more octane barrels. The improved coke selectivity of the catalyst allows for increased cracking severity. Debottlenecking of wet gas compressors due to the lower hydrogen factor would provide a means for increasing conversion or throughput in the catalytic cracker.

DESCRIPTION OF THE DRAWING

The attached FIGURE of drawing illustrates a single riser fluidized catalytic cracking process.

DESCRIPTION OF THE INVENTION

Feeds

Hydrocarbon stocks suitable as feeds comprise petroleum fractions having an initial boiling point above 400° F., a 50% point range of at least 500° F. and an end point range of at least 600° F. Such hydrocarbon fractions include gas oils (including vacuum gas oils), thermal oils, residual oils, cycle stocks, whole top crudes, tar sand oils, shale oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 750° F. must be carried out under vacuum in order to avoid thermal cracking. The boiling temperatures utilized herein are expressed in terms of convenience of the boiling point corrected to atmospheric pressure.

Catalytic Cracking of the Invention

Conventional cracking catalyst components are generally amorphous silica-alumina and crystalline silica-alumina. Herein the catalyst comprises ZSM-20 which is described in U.S. Pat. Nos. 3,972,983 and 4,021,331, each of which is relied upon and incorporated by reference herein.

The synthetic ZSM-20 zeolite for use herein possesses a definite distinguishing hexagonal crystalline structure whose X-ray diffraction pattern shows substantially the significant lines set forth in Table A.

TABLE A

| d(A) | Relative Intensities |
|---|---|
| 14.90 ± 0.3 | VS |
| 14.21 ± 0.3 | VS |
| 8.67 ± 0.15 | M |
| 8.19 ± 0.15 | W |
| 7.44 ± 0.15 | W |
| 5.66 ± 0.10 | S |
| 5.34 ± 0.10 | W |
| 5.17 ± 0.10 | W |
| 5.00 ± 0.10 | W |
| 4.87 ± 0.10 | W |
| 4.74 ± 0.10 | W |
| 4.33 ± 0.09 | M |
| 3.98 ± 0.08 | W |
| 3.83 ± 0.08 | W |
| 3.76 ± 0.08 | M |
| 3.66 ± 0.07 | S |
| 3.60 ± 0.07 | W |
| 3.55 ± 0.07 | W |
| 3.45 ± 0.07 | W |
| 3.33 ± 0.07 | W |
| 3.29 ± 0.07 | M |
| 3.20 ± 0.06 | W |
| 2.90 ± 0.06 | M |
| 2.87 ± 0.06 | W |
| 2.84 ± 0.06 | M |
| 2.79 ± 0.06 | W |
| 2.75 ± 0.06 | W |
| 2.70 ± 0.05 | W |
| 2.61 ± 0.05 | M |
| 2.41 ± 0.05 | W |
| 2.37 ± 0.05 | W |
| 2.17 ± 0.04 | W |
| 2.14 ± 0.04 | W |
| 2.09 ± 0.04 | W |
| 2.05 ± 0.04 | W |

These values were determined by standard techniques. The radiation was the K-alpha doublet of copper, and a scintillation counter spectrometer with a strip chart pen recorder was used. The peak heights, I, and the position as a function of 2 times theta, where theta is the Bragg angle, were read from the spectrometer chart. From these, the relative intensities, 100 I/Io, where Io is the intensity of the strongest line or peak, and d(obs.), the interplanar spacing in Angstroms (A), corresponding to the recorded lines, wee calculated. In Table I, relative intensities are listed according to the following symbol definitions: VS=very strong, S=strong, M=medium and W=weak. It should be understood that this X-ray diffraction pattern is characteristic of all the species of ZSM-20 compositions. Ion exchange of the sodium ion with cations reveals substantially the same pattern with some minor shifts in interplanar spacing and variation in relative intensity. Other minor variations can occur depending on the silicon to aluminum ratio of the particular sample, as well as if it has previously been subjected to thermal treatment.

The major conventional cracking catalysts presently in use generally comprise a large pore crystalline silicate zeolite, generally in a suitable matrix component which may or may not itself possess catalytic activity. These zeolites typically possess an average crystallographic pore dimension of about 7.0 angstroms and above for their major pore opening. Representative crystalline silicate zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), merely to name a few, as well as naturally occurring zeolites such as chabazite, faujasite, mordenite, and the like. Also useful are the silicon-substituted zeolites describes in U.S. Pat. No. 4,503,023. ZSM-4 and Zeolite Beta are yet another large pore crystalline silicates which can constitute component(s) of the mixed catalyst system utilized herein.

It is, of course, within the scope of this invention to employ two or more of the foregoing amorphous and/or large pore crystalline cracking catalysts in the catalyst composition. Preferred optional crystalline zeolite components of the catalyst composition herein include the natural zeolites mordenite and faujasite and the synthetic zeolites X and Y with particular preference being accorded zeolites Y, REY, USY and RE-USY.

A shape selective medium pore crystalline silicate zeolite catalyst can constitute an optional catalyst component of a mixed catalyst system of the invention. Representative of medium pore zeolites include ZSM-5, ZSM-11, ZSM-12, ZSM-23, ZSM-35, ZSM-48, ZSM-57 and other similar materials. U.S. Pat. No. 3,702,886 describing and claiming ZSM-5 is incorporated herein by reference. Also, U.S. Reissue Pat. No. 29,948 describing and claiming a crystalline material with an X-ray diffraction pattern of ZSM-5 is incorporated herein by reference as is U.S. Pat. No. 4,061,724 describing a high silica ZSM-5 referred to as "silicalite" therein.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

The preferred shape selective crystalline silicate zeolites of the catalyst composition herein are ZSM-5, ZSM-11, ZSM-12, ZSM-23, ZSM-35, ZSM-48 and ZSM-57 with ZSM-5 being particularly preferred.

The zeolite ZSM-20 used in the present invention can be modified in activity by dilution with a matrix component of significant or little catalytic activity. The matrix may provide a synergistic effect for large molecule cracking, and act as a coke sink. Catalytically active inorganic oxide matrix material is particularly desired because of its porosity, attrition resistance and stability under the cracking reaction conditions encountered particularly in a fluid catalyst cracking operation.

The catalytically active inorganic oxide may be combined with a raw or natural clay, a calcined clay, or a clay which has been chemically treated with an acid or an alkali medium or both. The matrix component is combined with the crystalline silicate in such proportions that the resulting product contains up to about 80% by weight of the crystalline silicate material and preferably from about 0.5% up to about 50 weight percent thereof may be employed in the final composite.

Naturally occurring clays which can be composited with the synthetic ZSM-20 catalyst include the montmorillonite and kaolin family, which families include the sub-bentonites, and the kaolins commonly known as Dixie, McNamee, Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the ZSM-20 catalyst can be composited with a porous matrix material such as silica-alumina, silica-magnesia, silica-zirconia, silica-thoria, silica-beryllia, silica-titania as well as ternary compositions such as silica-alumina-thoria, silica-alumina-zirconcia, silica-alumina-magnesia and silica-magnesia-zirconia. The matrix can be in the form of a cogel. A mixture of these components could also be used. The relative proportions of finely divided crystalline aluminosilicate ZSM-20 and inorganic oxide gel matrix vary widely with the crystalline aluminosilicate content ranging from about 1 to about 90 percent by weight and more usually in the range of about 2 to about 70 percent by weight of the composite.

The original cations of the as synthesized ZSM-20 for use herein can be replaced in accordance with techniques well known in the art, at least in part, by ion exchange with other cations. Preferred replacing cations include metal ions, ammonium ions, hydrogen ions and mixtures thereof. Particularly preferred cations are those which render the zeolite catalytically-active, especially for hydrocarbon conversion. These include hydrogen, hydrogen precursors (e.g. ammonium ions), rare earth metals, aluminum, metals of Groups IIIB, IVB, IIA, IIIA, IVA and VIII of the Periodic Table of Elements.

Synthetic ZSM-20 zeolites can be used herein either in the tetraethylammonium and alkali metal containing form, the alkali metal form and hydrogen form or another univalent or multivalent cationic form.

Typical ion exchange techniques would include contacting the synthetic ZSM-20 zeolite with a salt of the desired replacing cation or cations. Although a wide variety of salts can be employed, particular prefrence is given to chlorides, nitrates and sulfates.

Some of the above metals are useful in promoting the oxidation of carbon monoxide to carbon dioxide under regenerator conditions as described in U.S. Pat. No. 4,350,614.

Representative ion exchange techniques are disclosed in a wide variety of patents including U.S. Pat. Nos. 3,140,249; 3,140,251; and 3,140,253.

Following contact with the salt solution of the desired replacing cation, the zeolite for use herein is then preferably washed with water and dried at a temperature ranging from 150° F. to about 600° F. and thereafter may be calcined.

Suitable charge stocks for cracking in the riser comprise the heavy hydrocarbons generally and, in particular, petroleum fractions having an initial boiling point range of at least about 400° F., a 50% point range of at least about 500° F. and an end point range of at least about 600° F. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated or thermally treated feedstocks derived from any of the foregoing, and the like.

The catalytic cracking process can be fixed bed, moving bed or fluidized bed in the hydrocarbon chargestock flow may be either concurrent or countercurrent to the conventional catalyst flow. The process of this invention is particularly applicable to the fluid catalytic cracking process.

Referring now to the FIGURE, hot regenerated catalyst contain zeolite ZSM-20 is transferred from regenerator 46 through conduit 4 provided with flow control valve 5 to the lower region 6 of riser 2 where it can combine with a hydrogen-rich hydrocarbon feed, e.g., $C_{1-5}$ light hydrocarbons (paraffins and olefins) recovered from gas plant operation 75, introduced therein through conduit 80. Said feed undergoes thermal cracking in lower region 6 due to the presence of the hot catalyst mixture. Selective catalytic cracking of paraffinic materials can also take place due to the presence of ZSM-5 in the catalyst mixture. The conditions of conversion of the $C_{1-5}$ light hydrocarbon feed in the lower region of riser 31 can include a temperature of from about 900° F. to about 1500° F. and preferably from about 1250° to about 1350° F., a catalyst to feed ratio of from about 50:1 to about 200:1 and preferably from about 100:1 to about 150:1 and a catalyst contact time of from about 10 to about 50 seconds and preferably from about 15 to about 35 seconds. The net result of this thermal/catalytic cracking activity in lower region 6 is to provide mobile hydrogen and/or carbon-hydrogen fragments for addition to the thermally treated heavy hydrocarbon feed introduced further up the riser.

The catalyst-hydrocarbon suspension formed in lower region 6 of riser 2 continues to ascend the riser, it enters an intermediate region 7 and there can be combined with a cofeed introduced to the riser through conduit 10.

In general, the temperature within intermediate region 7 of riser 2 can be maintained within the range of from about 950° to about 1150° F., preferably from about 1000° to about 1100° F., a catalyst to feed ratio of from about 3:1 to about 10:1, preferably from about 4:1 to about 8:1 and a catalyst contact time of from about 0.5 to about 10 seconds, preferably from about 1 to about 5 seconds. The hydrocarbon product/catalyst stream continues upwardly within riser 2 to an upper region 12 thereof where it combines with hot freshly regenerated catalyst transferred from regenerator 46 through conduit 14 provided with valve 15 and optionally with a cofeed such as gas oil introduced through line 16. The conversion conditions in upper region 12 can be essentially the same as those in intermediate region 7. The cofeed introduced via line 16 undergoes cracking in upper region 12 to provide additional quantities of gasoline boiling range material. The catalyst-hydrocarbon suspension continues to travel up the riser and is ultimately discharged into cyclonic separation zones 18 and 20 housed in the upper portion of vessel 22 wherein separation of catalyst from hydrocarbon vapors is accomplished.

Hydrogen, gases and hydrocarbon vapors separated from catalyst then pass into a plenum chamber 24 for removal from the vessel by conduit 26. Catalyst separated from hydrocarbon vapors in cyclonic means 18 and 20 pass by diplegs 28 and 30 to a fluid bed of catalyst 32 maintained in the lower portion of the vessel 22. The fluid bed of catalyst 32 is in open communication with a lower extending stripping zone 34 therebelow to which the fluid bed of catalyst moves generally downward countercurrent to rising stripping gas introduced by conduit 36. The stripping zone is maintained at a temperature within the range of 900° F. to 1150° F. and the higher temperature may be facilitated by the addition of hot regenerated catalyst to the catalyst in the stripping zone by means not shown. Stripped catalyst is removed from a bottom portion of the stripping zone by conduit 38 for transfer to regenerator 46.

Catalyst particles comprising particularly the zeolite cracking component of the catalyst composition accumulate a relatively high level of entrained hydrocarbonaceous material therein which is subsequently removed therefrom by regeneration with oxygen-containing regeneration gases. The stripped catalyst particles are passed by conduit 38 to a catalyst regeneration unit represented by regenerator 46 containing a dense fluid bed of catalyst 48. Regeneration gas such as air is introduced to the lower portion of regenerator 46 by air distributor 50 supplied by conduit 52. Cyclone separators 54 provided with diplegs 56 separate entrained catalyst particles from flue gases and return the separated catalyst to the fluid bed of catalyst. Flue gases pass from the cyclones into a plenum chamber and are removed therefrom by conduit 58. Hot regenerated zeolite catalyst is returned to the lower and upper regions of riser 2 by conduits 4 and 14, respectively, as discussed above to participate in another cycle of conversion.

The hydrocarbon products of conversion are conveyed from plenum chamber 24 through conduit 26 and are introduced to fractionation zone 56 where a separation of the products is made. Main column bottoms (MCB) are conveyed from the fractionator by conduit 60 for recycle to riser 2 through conduit 16 or for some other use. A heavy cycle oil (HCO) product is withdrawn by conduit 62. A light cycle oil (LCO) product is withdrawn by conduit 64. An overhead fraction lower boiling than the light cycle oil and comprising gasoline and lower boiling hydrocarbons are withdrawn from an upper portion of fractionator 56 by conduit 66. The withdrawn material in conduit 66 passes through cooler 68 and conduit 70 to knockout drum 72 wherein condensed liquids such as water and gasoline boiling material are separated from lower boiling gaseous components.

The low boiling gaseous components are withdrawn by conduit 74 for passage to a light ends recovery operation 75 wherein a separation is made to recover, $C_{1-5}$ paraffins for recycle through conduit 80. A gasoline boiling range fraction separated in drum 72 is recycled by conduit 81 as reflux to the fractionator tower.

The gas compressor (not shown) in conduit 74, compresses gas from the FCC which is then directed to the gas recovery plant. It is the volume capacity of that gas compressor inter alia can limit the FCC throughput. Upgrading heavy hydrocarbon feeds, under the foregoing conditions provides gasoline product and yields higher octane, lower coke and lower hydrogen factors than conventional cracking catalyst. The lower hydrogen factor (more $C_1$, $C_2$ vs. $H_2$) indicates higher product gas molecular weight. Thus, more gas (on a weight basis) can be compressed by the wet gas compressor at constant volume throughput. This allows increased conversion in FCC units that are gas compressor limited. The catalyst's lower hydrogen factor also allows processing of metal Ni and V containing feeds particularly at lower catalyst make-up rates and with less metals passivator addition than for USY.

Although the foregoing is a general discussion of the present invention and described embodiments in support thereof, and the Examples illustrate the invention, it is to be understood that no undue restrictions are to be imposed by reason thereof except as provided by the following claims.

EXAMPLES

Example 1

A cracking catalyst containing 20 wt % ZSM-20 in a $SiO_2/Al_2O_3$/kaolin clay (60.45/4.55/35 wt/wt/wt) was prepared. The catalyst was $NH_4NO_3$ exchanged following spray drying and dried at 250° F. for at least 16 hours. It was then calcined at 1000° F. for 3 hours each with nitrogen and air to remove the organic in the zeolite and re-exchanged with $NH_4NO_3$ to remove Na.

Example 2

A cracking catalyst containing 20 wt % of Davison USY (Z-14US) in the same matrix as in Example 1 was $NH_4NO_3$ exchanged following spray drying and dried at 250° F. for at least 16 hours.

Example 3

The catalysts in Examples 1 and 2 were steamed for 10 hours at 1450° F. with a steam/air (45/55) mixture at atmospheric pressure in a fluidized bed steaming apparatus.

Example 4

The catalysts of Example 3 were each catalytically evaluated in a fixed fluidized-bed unit at 960° F. and 1.0 minute on stream using Joliet Sour Heavy Gas Oil (JSHGO) as feed. Properties of this feed are shown in Table 1. The catalyst to oil ratio was varied to cover a wide range of conversions. The product yields and properties at 65 vol % conversion are compared in Table 2. The results show that the ZSM-20 containing catalyst gives higher gasoline and LFO yield, higher octane (both RON and MON), lower coke and lower hydrogen factors. When compared on a constant coke basis (Table 3), the better coke selectivity of ZSM-20 translates into higher conversion which further increases the gasoline yield benefit.

TABLE 1

| Properties of Joliet Sour Heavy Gas Oil (JSHGO) | |
|---|---|
| Gravity, API | 24.3 |
| Aniline PT., °F. | 171 |
| Hydrogen, wt. % | 12.3 |
| Sulfur, wt. % | 1.87 |
| Nitrogen, wt. % | 0.10 |
| Basic Nitrogen, ppm | 327 |
| Conradson Carbon, wt. % | 0.28 |
| Kinematic Viscosity at 210° F. | 3.6 |
| Bromine No. | 4.2 |
| R.I. at 70° F. | 1.5080 |
| Molecular Weight | 358 |
| Pour Point, °F. | 85 |
| Paraffins, wt. % | 23.5 |
| Naphthenes, wt. % | 32.0 |
| Aromatics, wt. % | 44.5 |
| Aromatic Carbon, wt. % | 18.9 |

TABLE 1-continued

| Properties of Joliet Sour Heavy Gas Oil (JSHGO) | |
|---|---|
| Ni, ppm | 0.3 |
| V, ppm | 0.6 |

TABLE 2

| Comparison of ZSM-20 with USY at Constant Conversion | | |
|---|---|---|
| | ZSM-20 | USY |
| Conversion, vol. % | 65 | 65 |
| Product Yields | | |
| $C_5$+ Gasoline, vol. % | 50.2 | 49.8 |
| Total $C_4$, vol. % | 16.4 | 16.3 |
| $C_3$−, wt. % | 8.7 | 8.6 |
| Coke, wt. % | 2.4 | 2.6 |
| $H_2$, wt. % | 0.03 | 0.06 |
| LFO, wt. % | 30.5 | 29.8 |
| HFO, wt. % | 7.0 | 7.7 |
| G+D | 71.5 | 70.8 |
| Hydrogen Factor | 19 | 45 |
| Gasoline Octanes | | |
| RON+O | 91.2 | 90.5 |
| MON+O | 80.3 | 79.7 |

TABLE 3

| Comparison of ZSM-20 with USY at Constant Coke Yield | | |
|---|---|---|
| | ZSM-20 | USY |
| Conversion, vol. % | 65.7 | 63.7 |
| Product Yields | | |
| $C_5$+ Gasoline, vol. % | 50.5 | 48.9 |
| Total $C_4$, vol. % | 16.7 | 15.9 |
| $C_3$−, wt. % | 8.7 | 8.2 |
| Coke, wt. % | 2.5 | 2.5 |
| $H_2$, wt. % | 0.03 | 0.06 |
| LFO, wt. % | 30.1 | 31.1 |
| HFO, wt. % | 6.8 | 7.7 |
| G+ D | 71.3 | 71.5 |
| Hydrogen Factor | 19 | 45 |
| Gasoline Octanes | | |
| RON + O | 91.2 | 90.5 |
| MON + O | 80.3 | 79.7 |

In accordance with the invention, the process provides

Higher gasoline and distillate yield, higher octane and lower coke and better back end conversion than conventional USY containing cracking catalysts at constant conversion and higher gasoline yield at constant coke.

Moreover the process is characterized by a lower hydrogen factor than those processes based on USY containing catalysts permitting debottlenecking of wet gas compressor and higher metals on the catalyst.

What is claimed is:

1. In a fluid catalytic cracking process, undertaken in the presence of a large pore size zeolite catalyst, in a riser, to upgrade a first volume of a heavy hydrocarbon feedstock to produce gasoline during which upgrade a volume of gaseous products is produced comprising a mixture of $C_1$ hydrocarbon (methane), $C_2$ hydrocarbons, selected from the group consisting of, ethylene, and admixtures of ethane and ethylene, and $H_2$; wherein the gaseous products are compressed in a compressor of a fixed volume capacity, and then, in turn, conveyed to a gas processing plant; wherein catalyst spent during cracking is conveyed to a regenerator for regeneration and, after regeneration, is conveyed to said riser, the improvement comprising passing a heavy hydrocarbon feed through the riser;

subjecting the feed to catalytic cracking conditions by passing a catalyst composition comprising ZSM-20 in acid form and a matrix through the riser at conditions including a temperature of about 950° F. to about 1150° F., a catalyst to feed ratio of 3:1 to about 10:1 and a catalyst contact time of from about 1 to about 20 seconds; whereby said volume of gaseous products is reduced and the volume of hydrogen in the mixture is reduced to a total volume less than that of said fixed volume capacity during said catalytic cracking conditions;

increasing the feed throughput to the riser for catalytic cracking so that the mixture containing hydrogen produced during upgrading of the feed has a volume which approaches the fixed volume capacity of the compressor wherein said feed throughput is a second volume which exceeds said first volume; and recovering gasoline.

2. The process of claim 1, wherein increasing the feed throughput increases production of said mixture to equal said fixed volume capacity.

3. The process of claim 1, wherein the catalyst composition further includes a zeolite selected from the group consisting of ZSM-5, zeolite beta, zeolite Y and USY.

4. The process of claim 1, wherein the matrix comprises 1 to about 90 percent by weight of the composite.

5. The process of claim 1, undertaken in the absence of added hydrogen.

6. A catalytic cracking process, undertaken in the presence of a catalyst, in a catalytic cracking zone, to upgade a first volume of a heavy hydrocarbon feedstock to produce gasoline, during which upgrade a volume of light gaseous products is produced comprising a mixture of $C_1$ hydrocarbon (methane), $C_2$ hydrocarbons selected from the group consisting of, ethylene and admixtures of ethane and ethylene and $H_2$; wherein the gaseous products are compressed in a compressor of a fixed volume capacity, and then, in turn, conveyed to a gas processing plant; wherein catalyst spent during cracking is conveyed to a regenerator for regeneration, is conveyed to said zone, the improvement comprising passing a heavy hydrocarbon feed through the zone;

subjecting the feed to a catalytic cracking conditions by contactin it with a catalyst composition comprising ZSM-20 in acid form whereby said volume of gaseous products is reduced and the volume of hydrogen in the mixture is reduced to a total volume less than that of said fixed volume capacity during said catalytic cracking conditions;

increasing the feed throughput to the zone for catalyst cracking so that the mixture containing hydrogen produced during upgrade of the feed has a volume which approaches the fixed volume capacity of compressor wherein said feed throughput is a second volume which exceeds said first volume; and recovering gasoline.

7. The process of claim 6, wherein ZSM-20 contains ammonium cations, acidic protons, metal ions, and admixtures thereof.

8. The process of claim 6, wherein said ZSM-20 contains rare earth metal cations and protons.

9. The process of claim 6, wherein said ZSM-20 further contains rare earth metal.

10. The process of claim 6, wherein a high metals containing feed is converted without increasing catalysts makeup, without the addition of metals passivator(s).

11. The process of claim 10, wherein the high metals content of said feed comprises nickel and vanadium.

12. The process of claim 6, wherein said catalyst contains 0.1 to about 100 parts per million of an oxidation promoter wherein said oxidation promoter is selected from the group consisting of platinum, palladium, iridium, osmium, rhodium, ruthenium, rhenium and mixtures thereof.

* * * * *

UNITED STATES PATENT AND TRADEMARK OFFICE

CERTIFICATE OF CORRECTION

PATENT NO. : 4,968,406

DATED : November 6, 1990

INVENTOR(S) : Mizrahi and Vartuli

It is certified that error appears in the above-identified patent and that said Letters Patent is hereby corrected as shown below:

Column 10, Line 29, before "undertaken" insert -- where said process is--

Signed and Sealed this

Twelfth Day of May, 1992

*Attest:*

DOUGLAS B. COMER

*Attesting Officer*

*Acting Commissioner of Patents and Trademarks*